US007516771B2

(12) United States Patent
Drew et al.

(10) Patent No.: US 7,516,771 B2
(45) **Date of Patent: *Apr. 14, 2009**

(54) LOCK LEVER MOUNTING BRACKET FOR HEADRAILS ON COVERINGS FOR ARCHITECTURAL OPENINGS

(75) Inventors: Terrence M. Drew, Superior, CO (US); James L. Miller, Henderson, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 185 days.

This patent is subject to a terminal disclaimer.

(21) Appl. No.: 11/474,564

(22) Filed: Jun. 26, 2006

(65) Prior Publication Data

US 2007/0000621 A1 Jan. 4, 2007

Related U.S. Application Data

(60) Provisional application No. 60/696,203, filed on Jun. 30, 2005.

(51) Int. Cl.
*E06B 9/00* (2006.01)

(52) U.S. Cl. ..... 160/902; 160/23.1; 160/38; 160/173 R; 160/173 V; 160/178.1 R; 160/178.1 V; 248/254; 248/262; 248/220.21; 248/220.22; 248/221.11; 248/222.11; 248/222.52

(58) Field of Classification Search ..... 160/23.1, 160/38, 902, 173 R, 173 V, 178.1 R, 178.1 V; 248/254, 220.21, 220.22, 221.11, 222.11, 248/222.52, 262

See application file for complete search history.

(56) References Cited

U.S. PATENT DOCUMENTS

| | | | | | |
|---|---|---|---|---|---|
| 2,520,272 | A * | 8/1950 | Bopp et al. | 160/176.1 V |
| 3,029,465 | A * | 4/1962 | Graber et al. | 16/94 D |
| 3,030,060 | A * | 4/1962 | Breuer | 248/265 |
| 3,291,194 | A * | 12/1966 | Kirtley et al. | 160/181 |
| 4,114,233 | A * | 9/1978 | Hamilton | 16/95 R |
| 4,580,753 | A * | 4/1986 | Hennequin | 248/264 |
| 4,938,443 | A * | 7/1990 | Rowe | 248/251 |
| 5,044,589 | A * | 9/1991 | Milne et al. | 248/265 |
| 5,131,616 | A * | 7/1992 | Biba | 248/265 |
| D329,294 | S * | 9/1992 | DuBeau et al. | D25/49 |
| 5,146,648 | A * | 9/1992 | Hudson | 16/94 R |
| 5,186,426 | A * | 2/1993 | Wada | 248/251 |
| 5,195,570 | A * | 3/1993 | Marocco | 160/178.1 R |
| 5,353,857 | A * | 10/1994 | Anderson | 160/178.1 R |
| 5,515,901 | A * | 5/1996 | Hall | 160/206 |
| 5,584,459 | A * | 12/1996 | Meyer | 248/251 |
| 5,626,177 | A * | 5/1997 | Colson et al. | 160/168.1 V |
| 5,820,091 | A * | 10/1998 | Kutscher | 248/220.21 |
| 6,186,457 | B1 * | 2/2001 | Carter | 248/251 |
| 6,202,967 | B1 * | 3/2001 | Fraczek | 248/261 |
| 6,299,115 | B1 * | 10/2001 | Kovach et al. | 248/262 |
| 6,322,029 | B1 * | 11/2001 | Sonnenberg et al. | 248/222.13 |

(Continued)

*Primary Examiner*—Katherine W Mitchell
*Assistant Examiner*—Philip S Kwon
(74) *Attorney, Agent, or Firm*—Dorsey & Whitney LLP

(57) ABSTRACT

A mounting bracket for a covering for architectural openings such as windows, doors, archways, and the like, includes complementary components on the headrail and the mounting bracket to permit the mounting bracket to be inserted into the headrail and a lock lever is provided with access forwardly of the headrail to lock the headrail in position on the mounting bracket or condition the mounting bracket for release of the headrail from a temporarily secured relationship.

6 Claims, 14 Drawing Sheets

U.S. PATENT DOCUMENTS 6,382,296 B1 * 5/2002 Judkins ..... 160/178.1 R
6,540,187 B2 * 4/2003 Carter ..... 248/251
6,557,303 B2 * 5/2003 Finke et al. ..... 49/409
6,561,475 B1 * 5/2003 Chuang ..... 248/264
6,585,208 B1 * 7/2003 Fraser ..... 248/251
6,619,366 B2 * 9/2003 Ciuca ..... 160/176.1 R
7,134,469 B2 * 11/2006 Drew et al. ..... 160/38
7,240,715 B2 * 7/2007 Hoffmann ..... 160/120
7,367,536 B1 * 5/2008 Anderson et al. ..... 248/251
2002/0027184 A1 * 3/2002 Kovach et al. ..... 248/262
2006/0016946 A1 * 1/2006 Bohlen ..... 248/231.9
2007/0000621 A1 1/2007 Drew et al.
2007/0144682 A1 * 6/2007 Drew et al. ..... 160/23.1

* cited by examiner

LOCK LEVER MOUNTING BRACKET FOR HEADRAILS ON COVERINGS FOR ARCHITECTURAL OPENINGS

CROSS-REFERENCE TO RELATED APPLICATION

The present application claims the benefit under 35 U.S.C. § 119(e) to U.S. Provisional Patent Application No. 60/696,203 ("the '203 application"), which was filed on Jun. 30, 2005 and entitled "Lock Lever Mounting Bracket For Headrails on Coverings for Architectural Openings." The '203 application is incorporated by reference into the present application in its entirety.

BACKGROUND OF THE INVENTION

1. Field of the Invention

The present invention relates generally to systems for mounting a headrail for a covering for an architectural opening and more specifically to a mounting bracket having a lever lock for securing the headrail to the mounting bracket.

2. Description of the Relevant Art

Coverings for architectural openings such as windows, doors, archways and the like typically include a retractable panel of material supported by a headrail. The coverings are typically movable between extended positions wherein the panel of material extends across the architectural opening and a retracted position where the panel of material is either wrapped or gathered within or immediately adjacent to the headrail. The headrail further includes control systems for moving the covering between extended and retracted positions and in the case of *Venetian blinds for tilting the slats of the blind between open and closed positions.

Headrails are provided in various forms and configurations dictated partly by aesthetics and partly by function. In any circumstance, mounting brackets are provided that can be secured to a frame around the architectural opening and utilized to support the headrail.

In most instances, the mounting brackets have some form of a release mechanism so that the headrail is releasably secured to the mounting bracket whereby when in use it is reliably secure to prevent an inadvertent removal but can be released and removed for cleaning purposes or the like.

Systems for releasably securing a headrail to mounting brackets have taken numerous forms including brackets with detents, depressible release arms, snap-on fingers or the like and efforts are continuing for devising more reliable and easy to operate systems.

SUMMARY OF THE INVENTION

The present invention embodies a system for releasably mounting a headrail for a covering for an architectural opening to mounting brackets in a reliable, efficient, and easy to operate manner. The headrail and mounting brackets are complementary in that the headrail can be temporarily snapped onto the mounting brackets and then firmly locked in a mounted position with a readily accessible lever arm.

The mounting bracket has a depressible catch arm that is automatically depressed by a ledge on the headrail as the headrail is advanced to a predetermined position relative to the mounting bracket at which point the catch arm snaps into a temporarily secured position. A lever arm on the bracket can then be manually pivoted to a lock position to activate a slide-lock bar that prevents the catch arm from again being depressed thereby securely locking the headrail to the mounting bracket to prevent an inadvertent removal of the headrail.

The lever arm of course can be moved to a release position to permit depression of the catch arm by applying reasonable manual force to the headrail.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
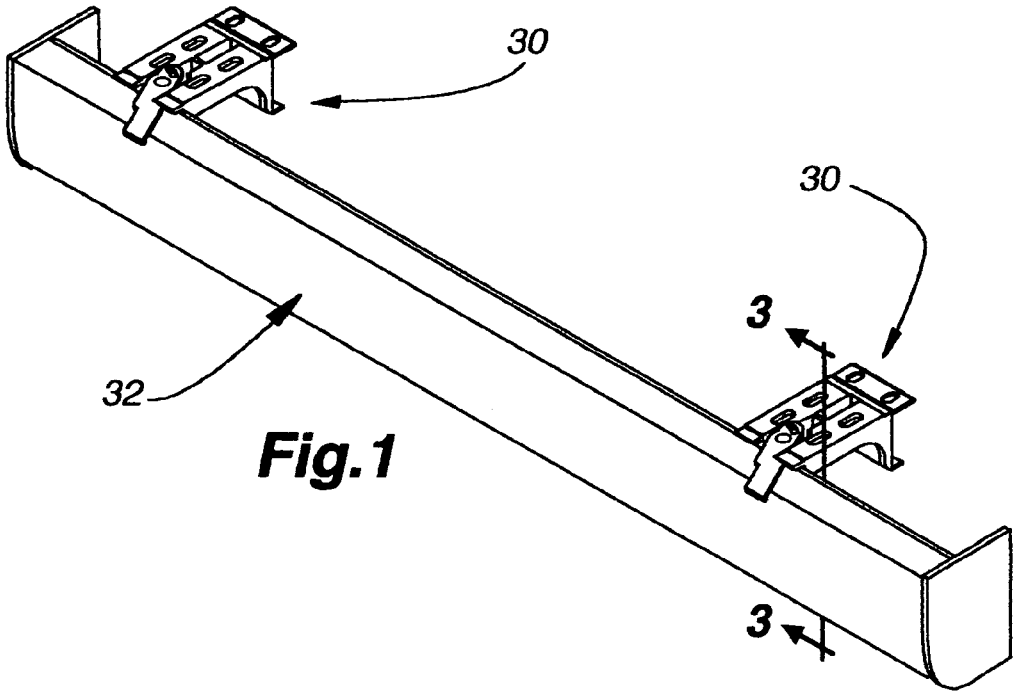
FIG. 1 is an isometric of a headrail for a covering for an architectural opening mounted on the mounting brackets of the present invention with lock levers in a locked position.
Figure 2:
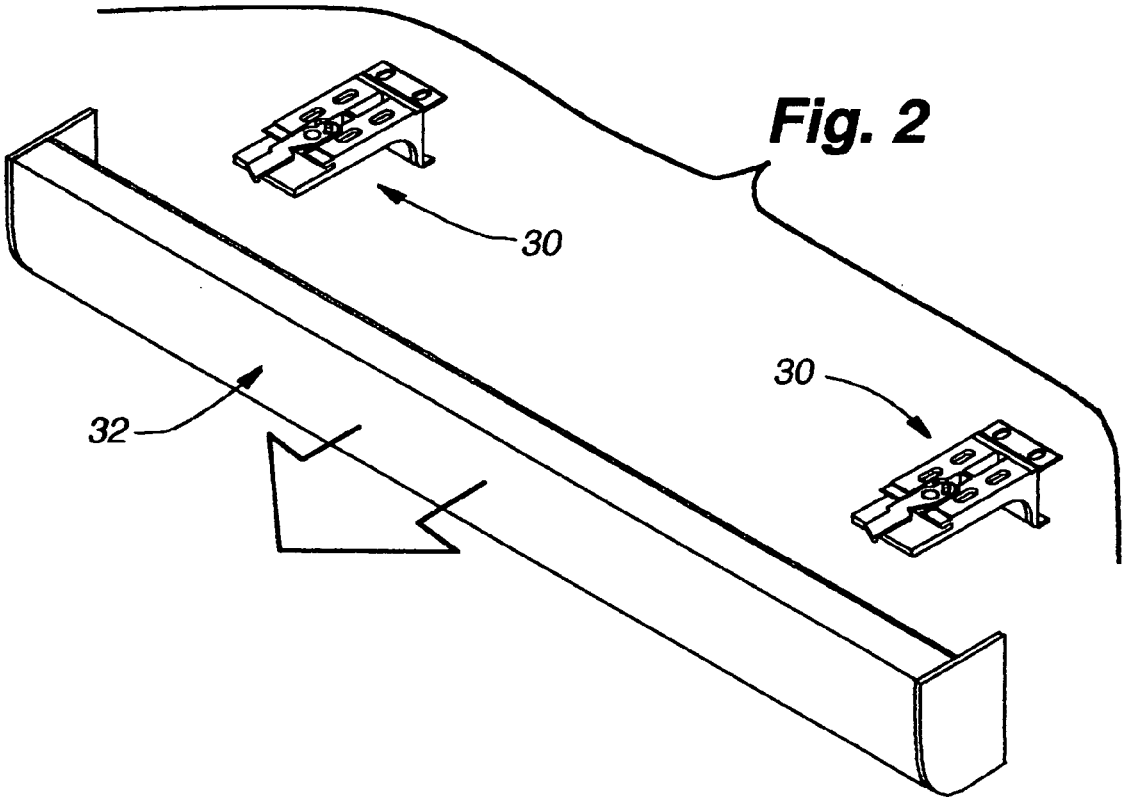
FIG. 2 is an exploded isometric similar to FIG. 1 with the lock levers in a release position.

With reference first to FIGS. 1 and 2, a pair of mounting brackets 30 in accordance with the present invention are seen with a headrail 32 for a covering for an architectural opening (not shown). While the frame for the architectural opening to which the brackets 30 can be mounted is not illustrated, the connection will be fully appreciated with the description of a bracket hereafter.

Figure 11:
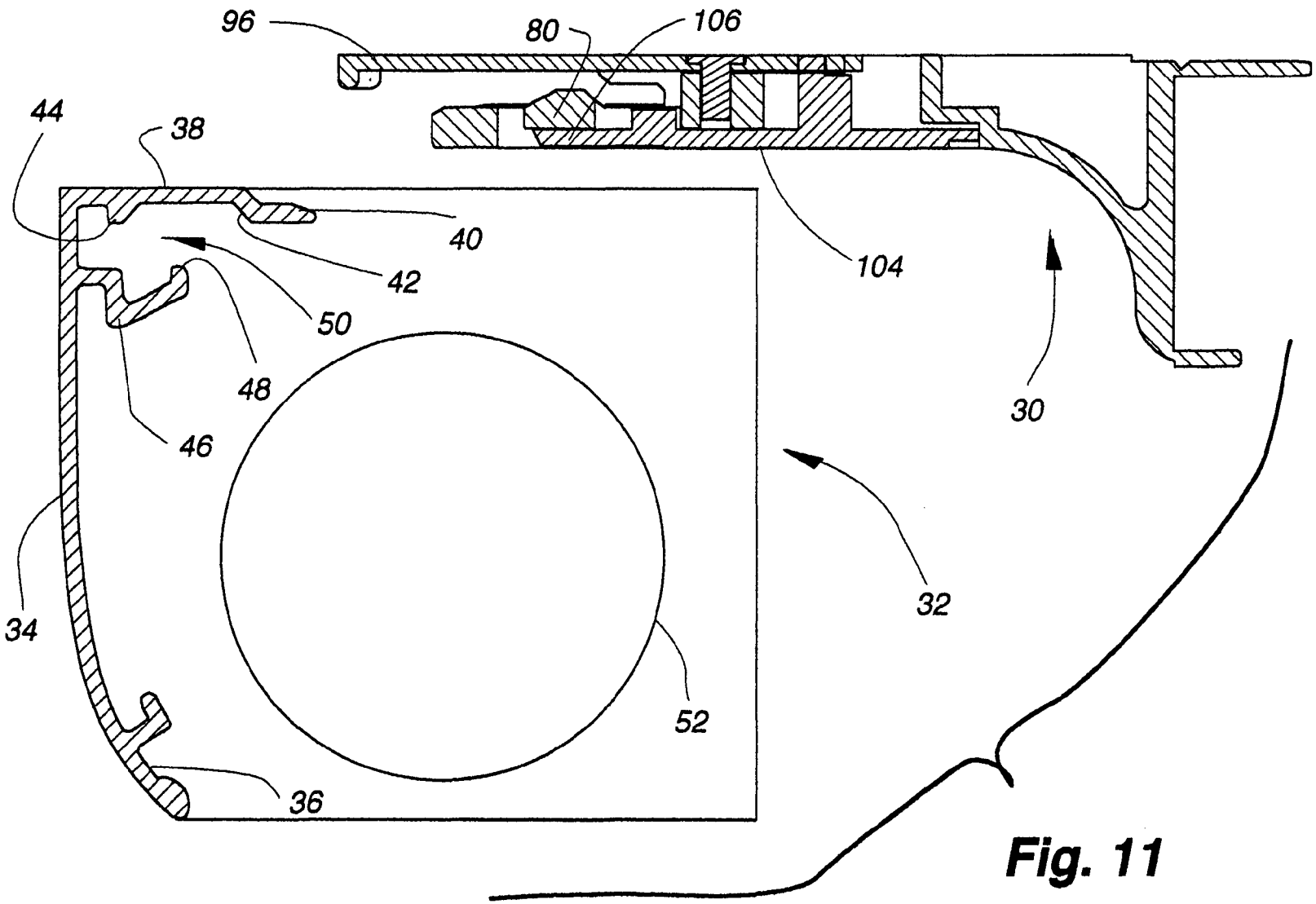
FIG. 11 is a section similar to FIG. 10 with the headrail removed from the mounting bracket.
Figure 12:
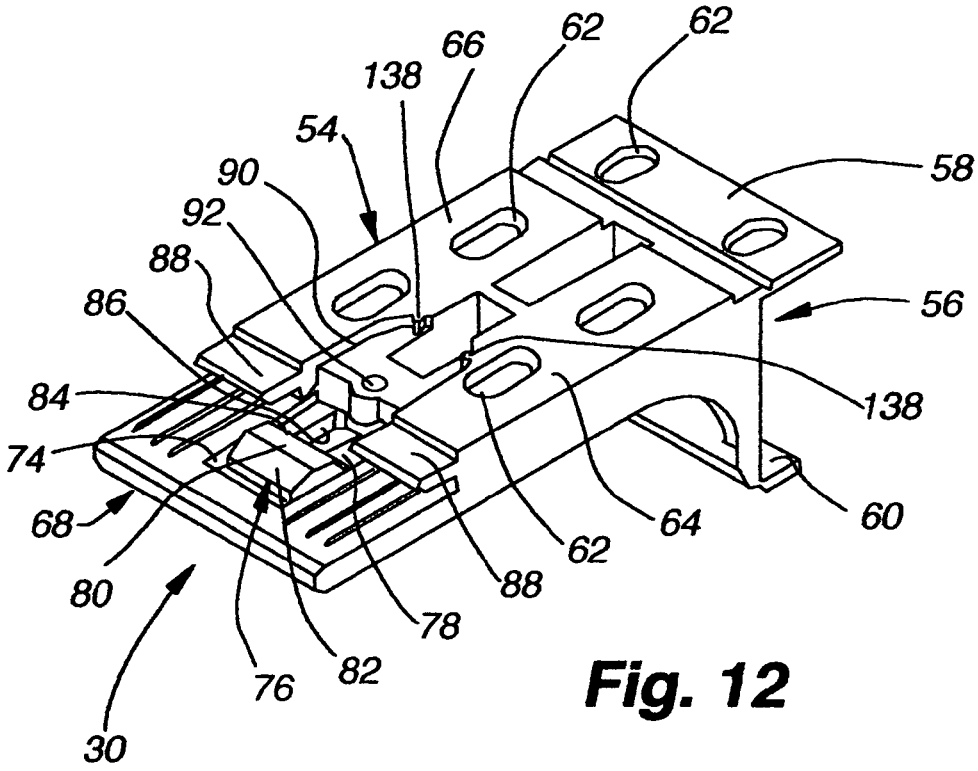
FIG. 12 is an isometric looking downwardly on the mounting bracket.

Before describing a bracket 30 in detail, it is best to understand the structure of the headrail 32 adapted for mounting on the bracket and the headrail is probably best illustrated in FIG. 11. The headrail can be seen to have a generally flat front wall 34 with an arcuate lower edge 36 and a relatively flat top wall 38 projecting rear wardly from the top edge of the front wall. The top wall has a depressed ledge 40 along its rear ward most edge defining a bevel surface 42 and a rib spacer 44 projecting down wardly at an intermediate location between the front wall 34 and the ledge 40. The headrail is typically extruded so that all of its features extend the full length of the headrail. At a predetermined spacing below the top wall, a support arm 46 extends rear wardly from the front wall of the headrail with the support arm having a lip 48 along its rear ward most edge. The lip 48, ledge 40, and rib spacer 44 all cooperate in defining a pocket 50 in which a portion of the mounting bracket can be inserted.

Figure 4:
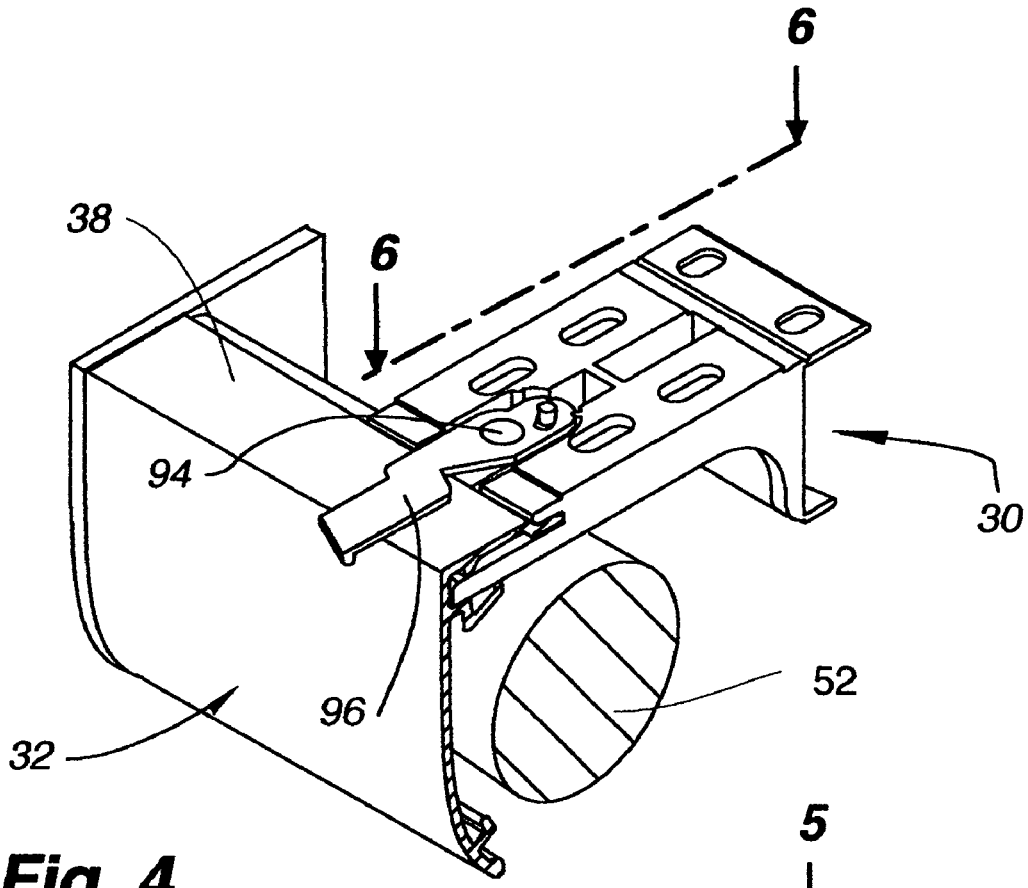
FIG. 4 is a section similar to FIG. 3 with the lock lever in a release position.
Figure 3:
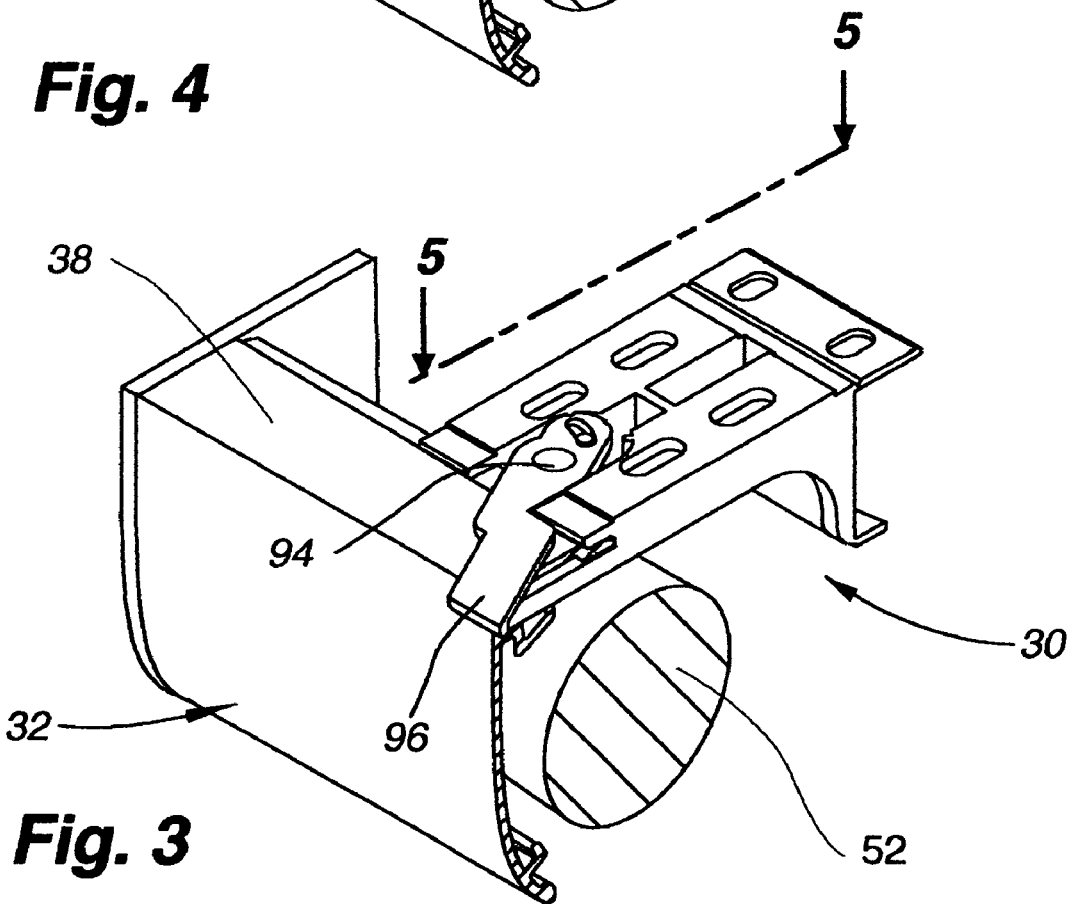
FIG. 3 is an enlarged section taken along line 3-3 of FIG. 1.

In FIGS. 3 and 4, the headrail 32 is shown connected to a mounting bracket 30 of the present invention with FIG. 4 showing the mounting bracket in a release position and FIG. 3 in a locking position. Further, a roller 52 which might be found in a headrail of a roll-up shade is illustrated positioned within the headrail and beneath the mounting bracket for illustrative purposes only. The mounting bracket is probably best seen in FIGS. 12-18. The bracket is made of a somewhat rigid plastic material having some flexibility depending upon the thickness of the plastic for purposes which will become apparent with the description hereafter.

The bracket 30 can be seen to have a horizontal base 54, a downturned back wall 56 off the rear edge of the base, and upper 58 and lower 60 horizontal flanges extending rear wardly from the back wall. The upper flange, the back wall, and the base all have openings 62 therethrough as possibly best seen in FIGS. 12, 13, 14, and 18 through which fasteners (not shown) can extend to secure the bracket to the frame around an architectural opening. The openings 62 are provided in both vertical and horizontal surfaces of the bracket so the bracket can be mounted to a vertical or horizontal surface of the frame depending upon the type of mounting desired for the covering.

The base 54 has a relatively thick rear portion 64 with a flat upper surface 66 and a slide plate 68 projecting forwardly from the rear portion along a lower edge thereof. The slide plate has a pair of support arms 70 along opposite sides and an integral lead bar 72 connecting the support arms along the forward most edge of the slide plate so as to define a rectangular opening 74 therebetween. The opening has a spring catch arm 76 positioned therein with the catch arm having a relatively thin portion 78 integrally connected with and extending forwardly from the relatively thick rear portion 64 of the base in a living hinge and a bevel head 80 at the forward most end of the thin portion. The bevel head has front 82 and rear 84 upwardly directed bevel surfaces for purposes to be described hereafter.

The thin portion 78 is adapted to flex slightly at the living hinge so that the bevel head 80 can be depressed within the rectangular opening 74 in the slide plate 68. The thin portion of the catch arm itself has a rectangular slot 86 formed therein for a purpose to be described hereafter. A pair of overhanging lips 88 project forwardly from the relatively thick rear portion 64 of the base in spaced overlying relationship with a rear portion of the slide plate 68. The overhanging lips define a space therebetween that is continuous with a shallow groove 90 formed in the flat upper surface 66 of the rear portion 64 of the base. A vertical hole 92 is provided in the shallow groove for receipt of a removable pivot pin 94 having an enlarged head as seen in FIGS. 7 and 9-11. The pivot pin pivotally secures a lock lever 96 to the base as will be described later.

Figure 8:
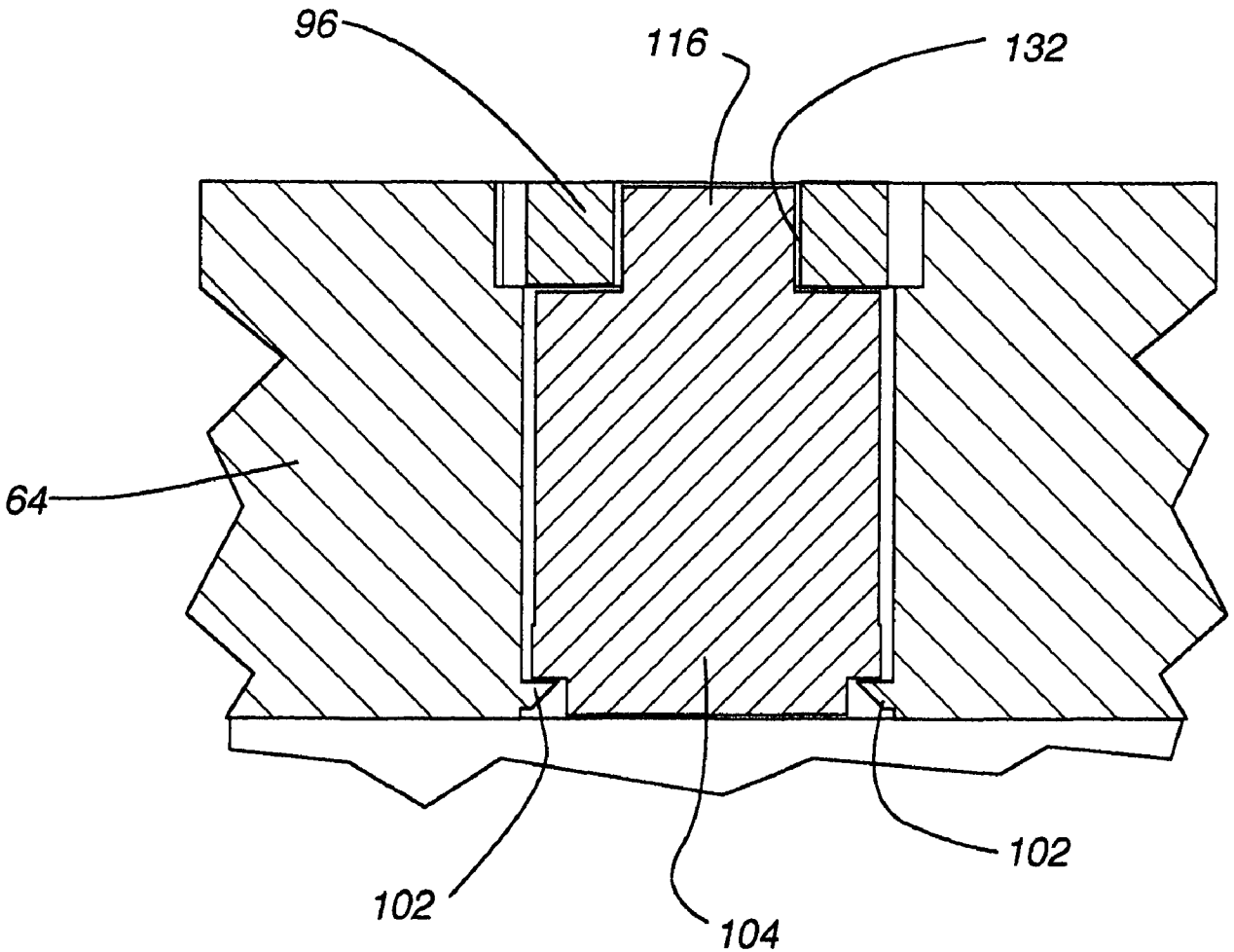
FIG. 8 is an enlarged fragmentary section taken along line 8-8 of FIG. 7.
Figure 13:
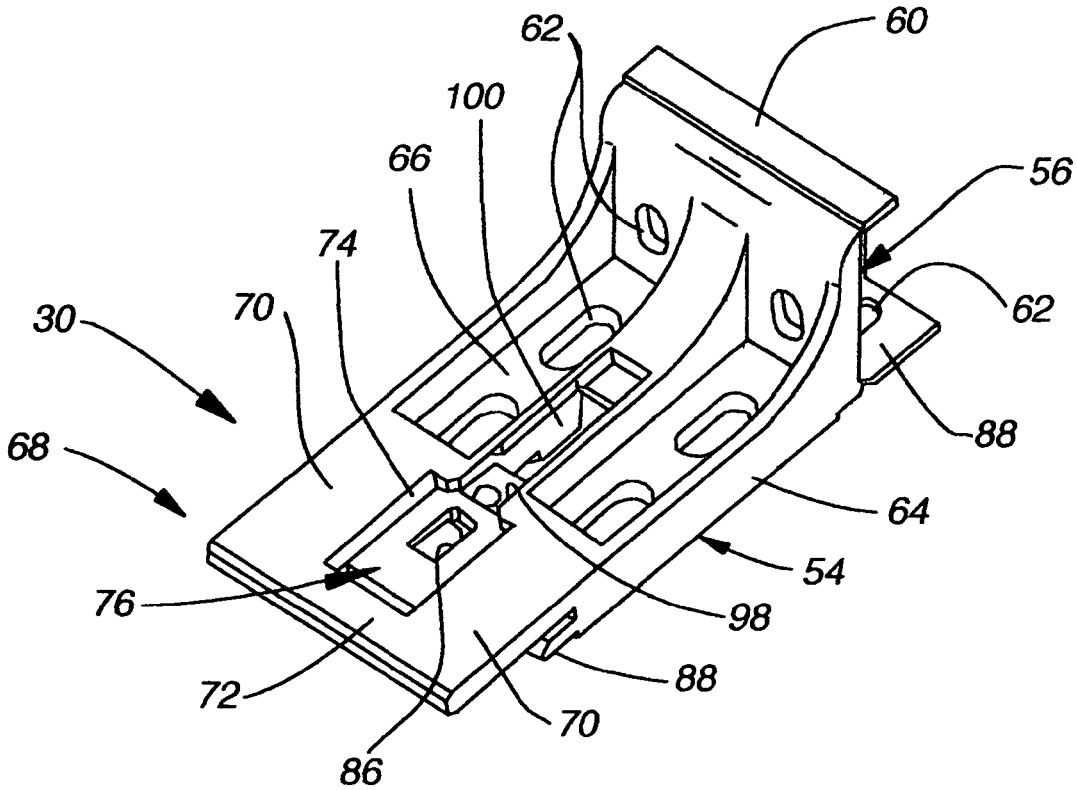
FIG. 13 is an isometric looking upwardly at the bottom of the mounting bracket of FIG. 12.
Figure 15:
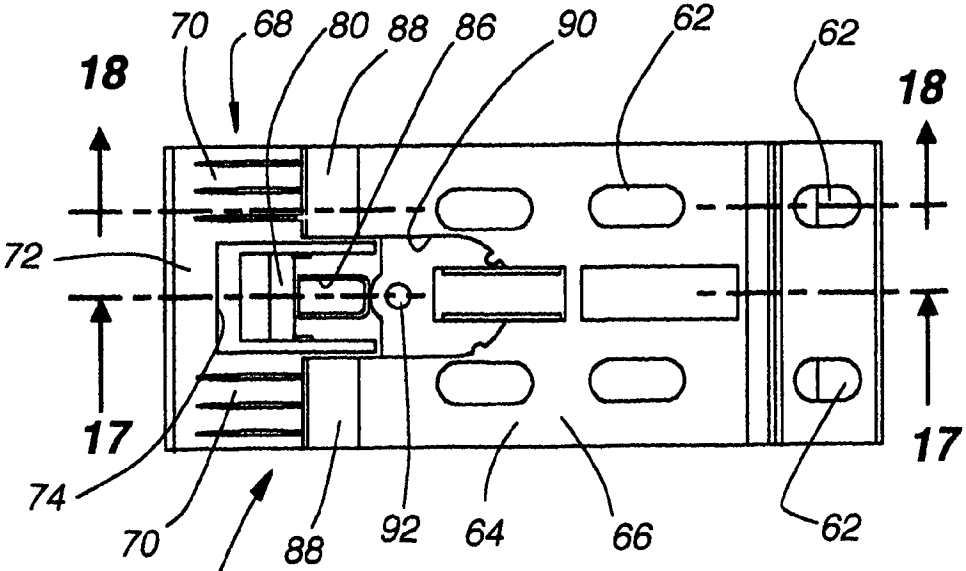
FIG. 15 is a top plan view of the mounting bracket.
Figure 16:
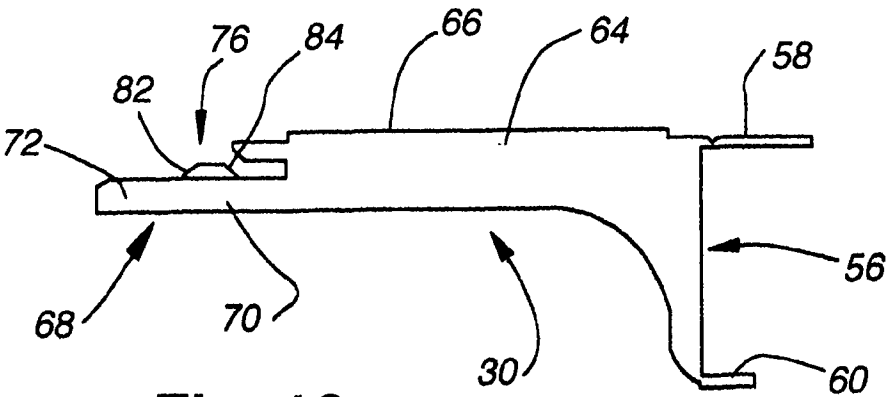
FIG. 16 is a side elevation of the mounting bracket.
Figure 14:
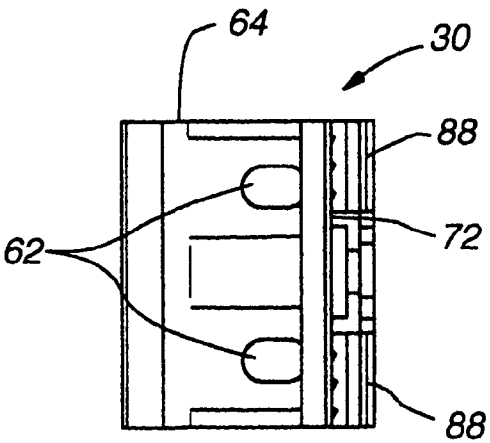
FIG. 14 is a left end elevation of the bracket as shown in FIG. 15.
Figure 17:
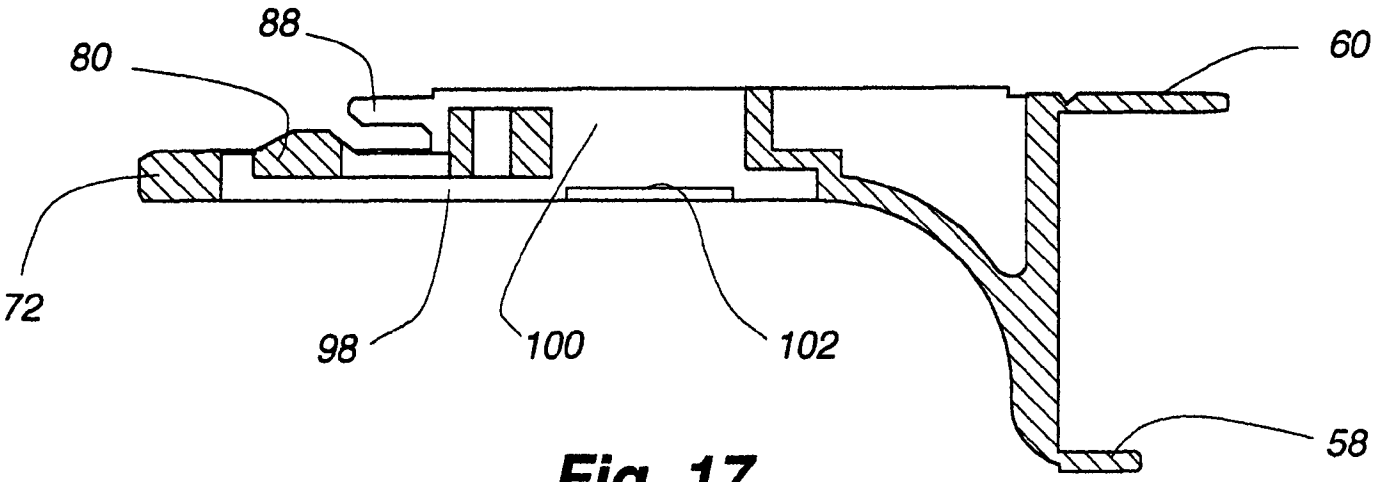
FIG. 17 is an enlarged section taken along line 17-17 of FIG. 15.
Figure 18:
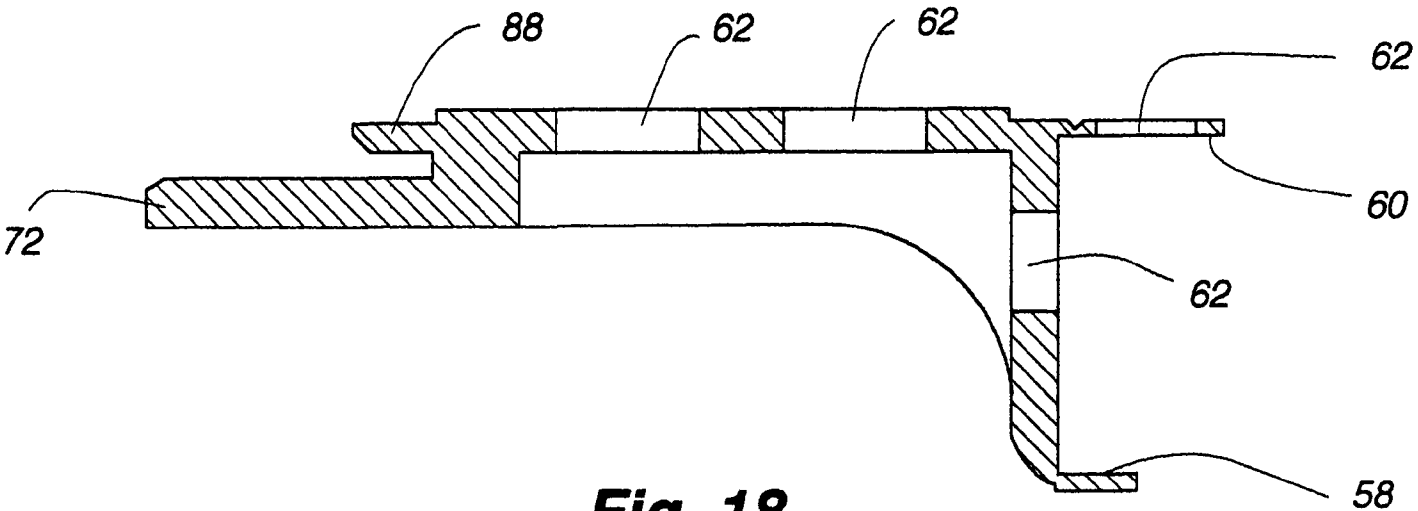
FIG. 18 is an enlarged section taken along line 18-18 of FIG. 15.
Figure 19:
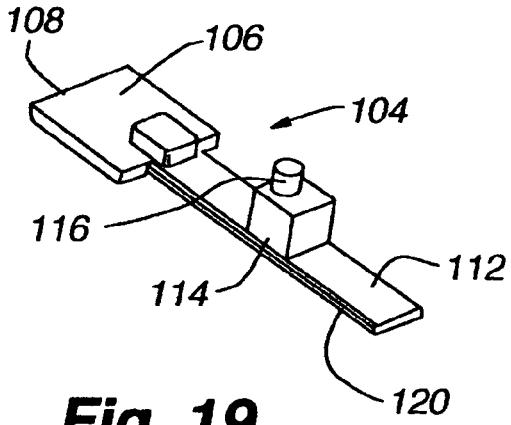
FIG. 19 is an isometric looking downwardly on the slide-lock bar of the mounting bracket.
Figure 20:
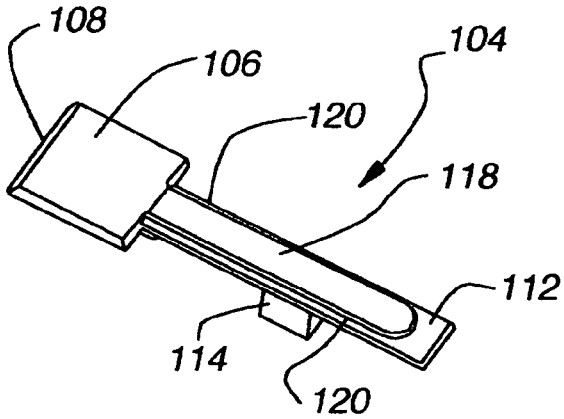
FIG. 20 is an isometric looking upwardly at the bottom of the slide-lock bar of FIG. 19.
Figure 21:
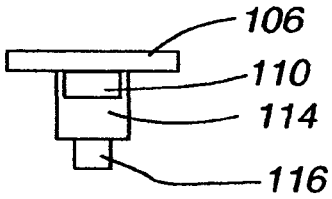
FIG. 21 is an end elevation of the slide-lock bar as shown in FIG. 22.
Figure 22:
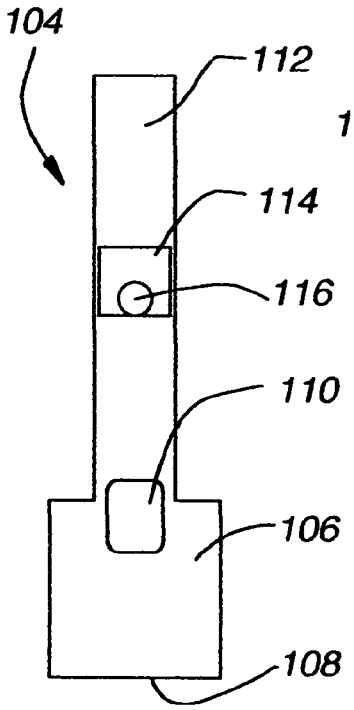
FIG. 22 is a top plan view of the slide-lock bar.
Figure 23:
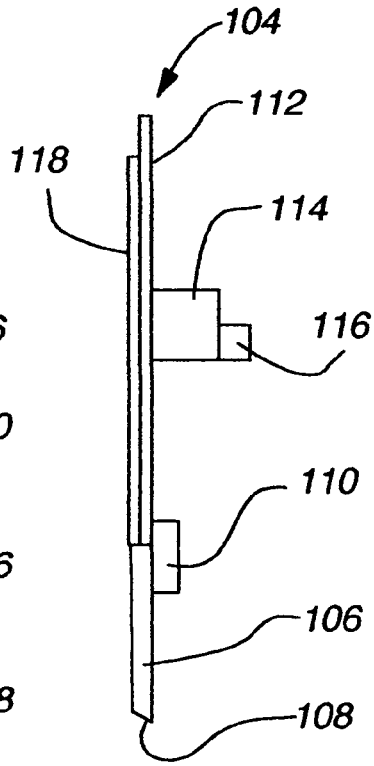
FIG. 23 is a side elevation of the slide-lock bar.
Figure 24:
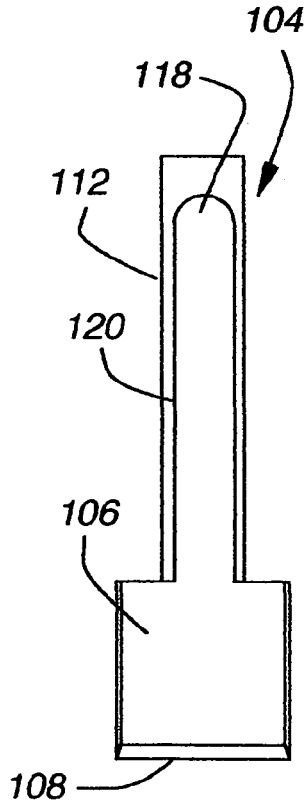
FIG. 24 is a bottom plan view of the slide-lock bar.
Figure 28:
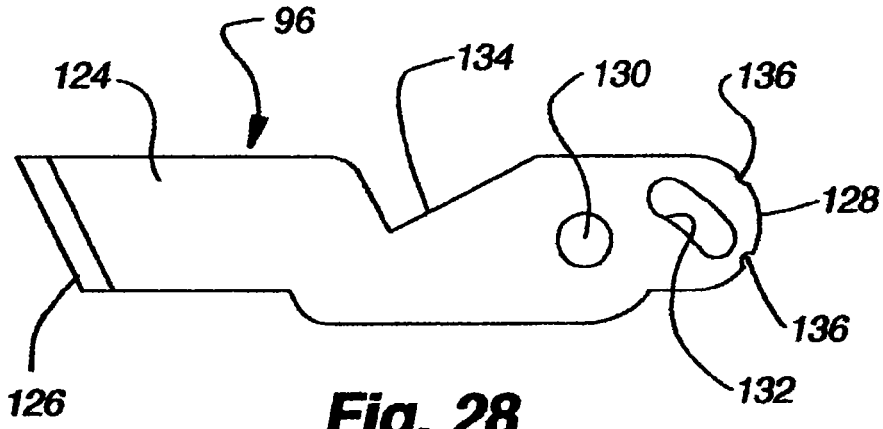
FIG. 28 is a top plan view of the lock lever.
Figure 27:
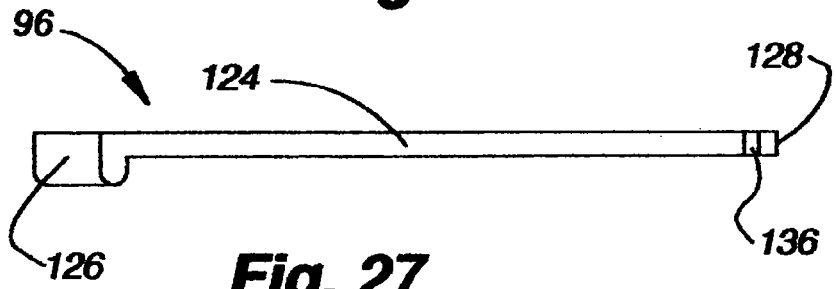
FIG. 27 is a side elevation of the lock lever.
Figure 26:
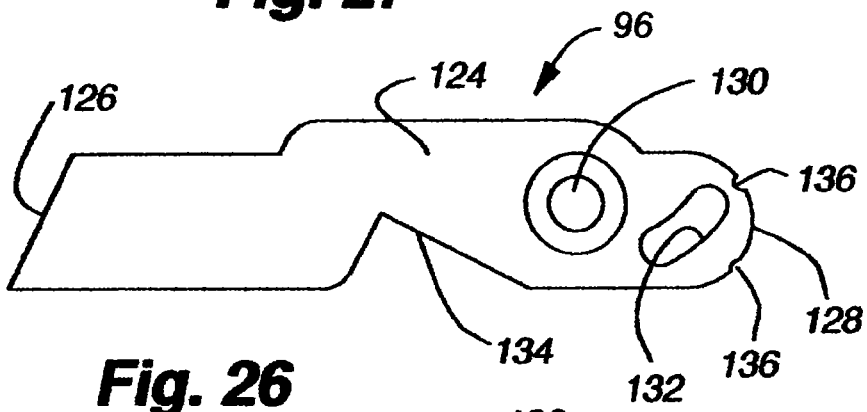
FIG. 26 is a top plan view of the lock lever.
Figure 25:
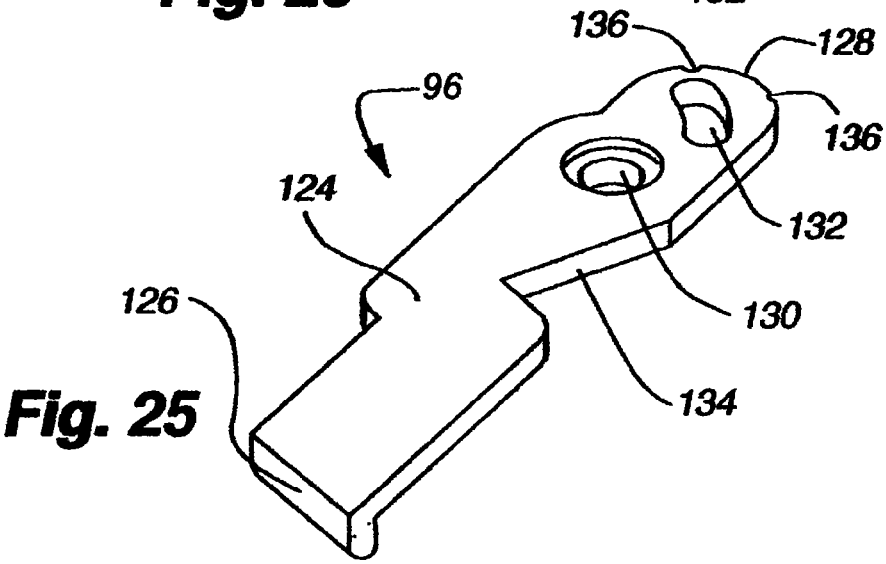
FIG. 25 is an isometric of the lock lever of the mounting bracket.

As possibly best seen in FIG. 13, the rectangular opening 74 in the slide plate 68 in which the spring catch arm 76 is positioned is continuous with a relatively narrow recessed channel 98 in the bottom of the relatively thick rear portion 64 of the base, which in turn is continuous with a slot-like opening 100 through the rear portion. As possibly best appreciated by reference to FIGS. 8 and 13, a pair of support shoulders 102 extend along the sides of the slot-like opening 100 in the base along the bottom thereof.

A slide-lock bar 104 shown in detail in FIGS. 8 and 19-24 is slidably positioned within the opening 74 in the slide plate, the continuous recessed channel 98 and slot-like opening 100 in the rear portion of the base. The slide-lock bar slidably underlies the spring catch arm 76. Referencing FIGS. 19-24, the slide-lock bar can be seen to have a flat paddle head 106 with a beveled leading edge 108, a guide block 110 extending upwardly from a rear portion of the paddle head and a slide arm 112 extending rear wardly from the paddle head. The slide arm has a raised block 114 at approximately its longitudinal center with the raised block having a cylindrical guide pin 116 projecting upwardly. The underside of the slide arm has an elongated centered tongue 118 formed integrally thereon (FIG. 20) which projects downwardly a small amount from the remainder of the slide arm. The tongue is also relatively narrow so as to define support edges 120 along opposite sides of the slide arm which are adapted to ride upon the support shoulders 102.

As probably best seen in FIGS. 7-13, the slide-lock bar 104 is positioned in the base 54 so that the support edges 120 on the underside of the slide-lock bar are supported on the support shoulders 102 for sliding movement and the paddle head 106 is disposed within the rectangular opening 74 in the slide plate 68 immediately beneath the spring catch arm 76. The guide block 110 on the paddle head projects into the rectangular slot 86 formed in the spring catch arm to assist in guiding sliding movement of the slide-lock bar. The slide-lock bar is also made of a relatively thin plastic so it too has some flexibility along its length. It should be noted that when the spring catch arm is depressed downwardly, it engages the top surface of the paddle head of the slide-lock bar also depressing the paddle head downwardly due to their uniform flexibility.

The lock lever 96, which is used to engage and disengage the locking mechanism in the bracket, is seen in detail in FIGS. 25-28. It can there be seen to have an elongated relatively flat body 124 with a diagonal gripping rib 126 at one end, a semicircular opposite end 128, a circular passage 130 extending vertically through the body at a location relatively close to the opposite end and an arcuate push-pull slot 132 extending vertically through the flat body between the circular opening and the opposite end of the flat body from the gripping rib. The push-pull slot while being arcuate extends at approximately a 45 degree angle relative to the length of the lever arm for a purpose to be described hereafter.

The lock lever 96 is secured to the base 54 by positioning the gripping rib 126 at a location beyond the slide plate 68 of the base with the opposite end 128 of the lock lever being positioned within the shallow groove 90 provided in the top surface of the base. The circular passage 130 through the lock lever is aligned with the hole 92 in the shallow groove in the base and the pivot pin 94 is inserted into the hole to pivotally connect the lock lever to the base. It should be appreciated the width of the lock lever body 124 is less than the width of the shallow groove so the lock lever is free to pivot within limits about the pivot pin. A notch 134 is provided in a side of the flat body 124 to accommodate the adjacent overhanging lip 88 when the lock lever is in the locking position of FIG. 3. With the lock lever attached to the base as described, the guide pin 116 on the slide-lock bar 104 extends into the push-pull slot 132 of the lock lever. As will be appreciated by pivoting the lock lever about the pivot pin, the push-pull slot forces the guide pin to move linearly along the length of the bracket so that the slide-lock bar can be moved reciprocally forwardly and rear wardly along the length of the bracket with pivotal movement of the lock lever.

Figure 5:
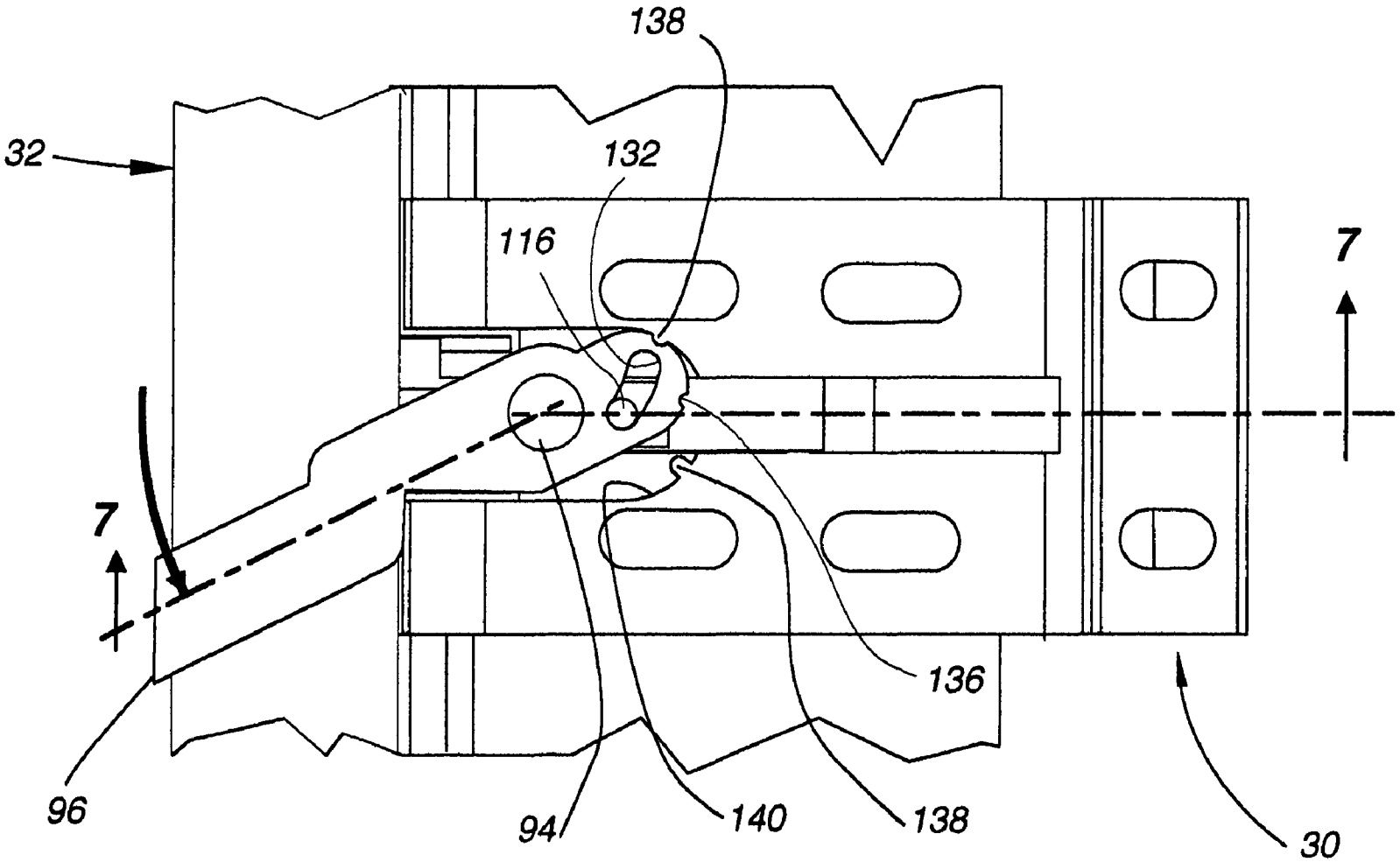
FIG. 5 is an enlarged fragmentary view taken along line 5-5 of FIG. 3.
Figure 6:
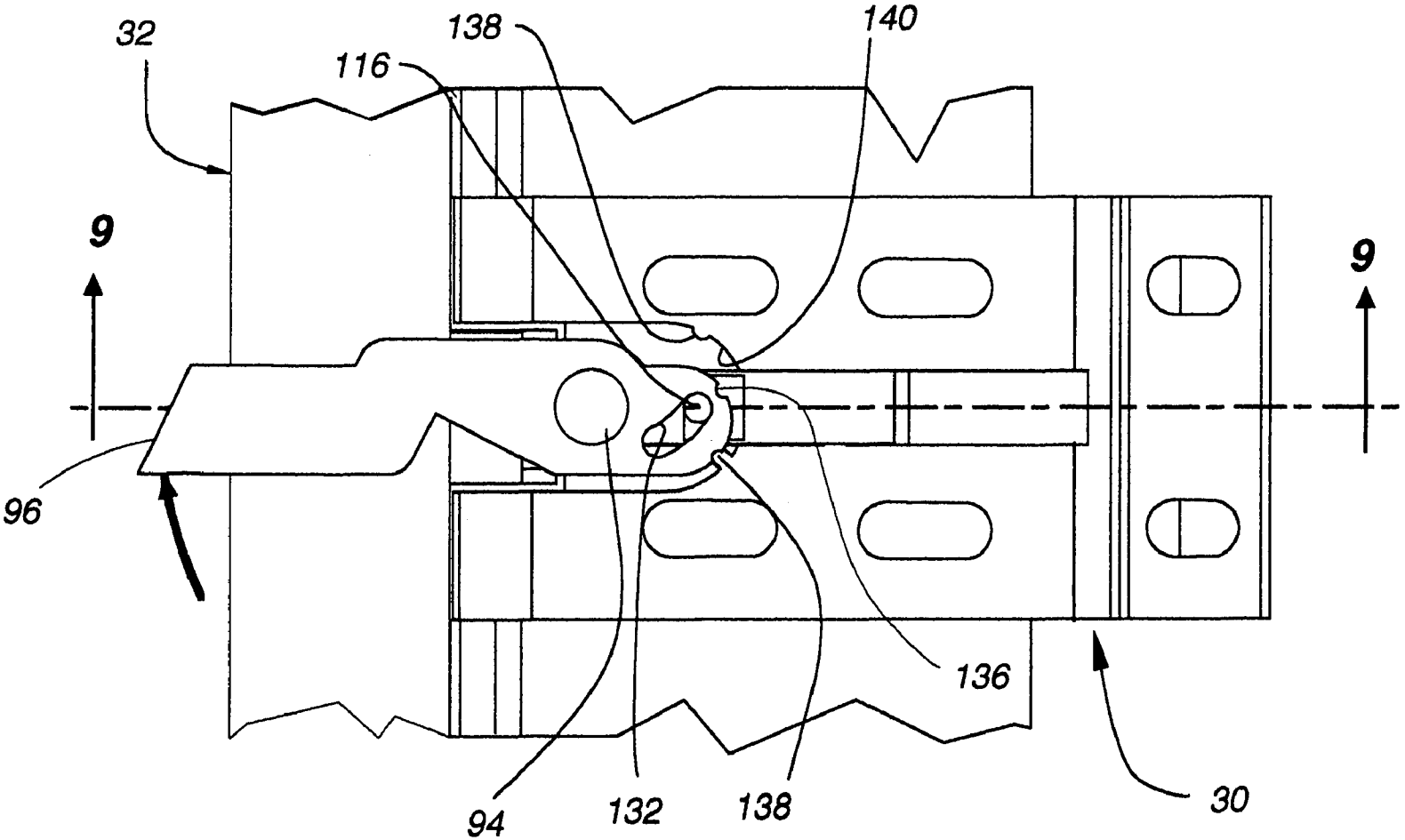
FIG. 6 is an enlarged fragmentary view taken along line 6-6 of FIG. 4.

As will be appreciated with the description later, when the lock lever 96 is aligned with the base as in FIG. 4, the slide-lock bar 104 is fully retracted toward the rear of the bracket 30 whereas when the lock lever is pivoted into the position shown in FIG. 3, the push-pull slot 132 advances the guide pin 116 pulling the slide-lock bar forwardly relative to the base 54. This movement of the slide-lock bar is probably best appreciated by reference to FIGS. 5 and 6. The lock lever has arcuately spaced detents 136 in its opposite end 128 that releasably receives vertical beads 138 formed in the adjacent arcuate wall 140 of the shallow groove 90. The detents and beads assist in retaining the lock lever in either a locking or release position to be described in more detail hereafter.

Figure 9:
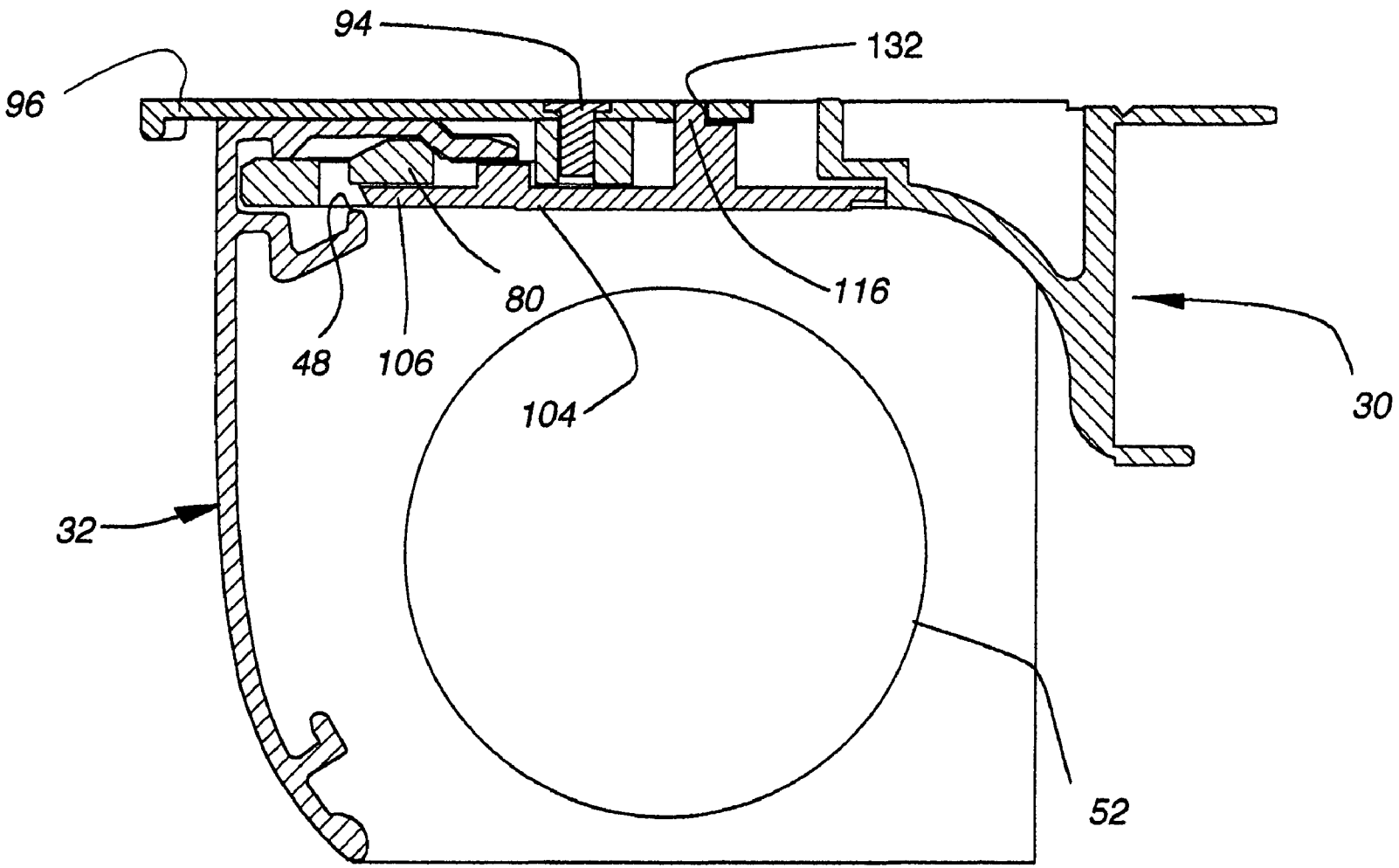
FIG. 9 is a section similar to FIG. 7 with the slide-lock bar in a release position.
Figure 10:
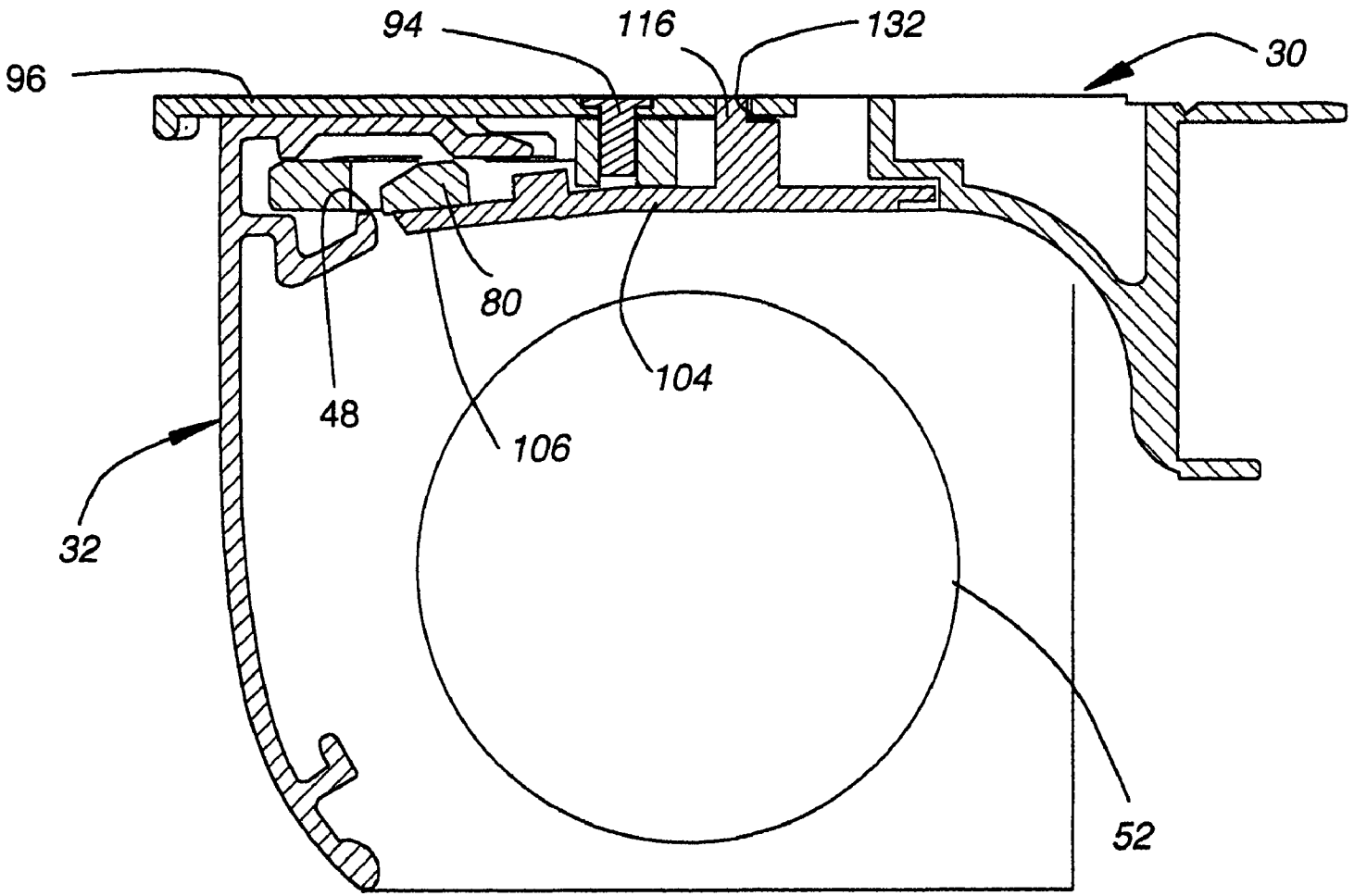
FIG. 10 is a section similar to FIG. 9 with the headrail positioned relative to the mounting bracket as it would be immediately before a temporary connection.

Looking next at FIG. 11, the mounting bracket 30 is shown positioned to receive the headrail 32 with FIG. 10 showing the headrail having been advanced partially onto the mounting bracket so that the lead bar 72 of the slide plate 68 is inserted into the pocket 50 in the headrail between the rib spacer 44 and the support arm 46. It should be noted in the position of FIG. 10, the front bevel 82 on the bevel head 80 has engaged and passed by the rear ledge 40 of the top wall 38. The engagement of the front bevel with the rear ledge cams the bevel head downwardly into the position of FIG. 10. In FIG. 9, the headrail is shown fully advanced onto the bracket in a neutral position where it will be appreciated the bevel head is positioned immediately in front of the bevel 42 on the rear ledge 40 of the top wall of the headrail. The rear bevel surface 84 on the catch arm 76 is engaged with the bevel 42 on the top wall of the headrail so that the headrail is temporarily but releasably secured to the bracket. As will be appreciated, if the headrail were to be pulled forwardly from the position illustrated in FIG. 9, the beveled engagement of the bevel 42 on the top wall with the rear bevel 84 on the catch arm would cam the catch arm downwardly as seen in FIG. 10 which would allow the headrail to be released from the bracket with a predetermined amount of force. As mentioned previously, the catch arm can be depressed from the position of FIG. 9 even though the slide-lock bar 104 is positioned there beneath because both elements are somewhat flexible.

Figure 7:
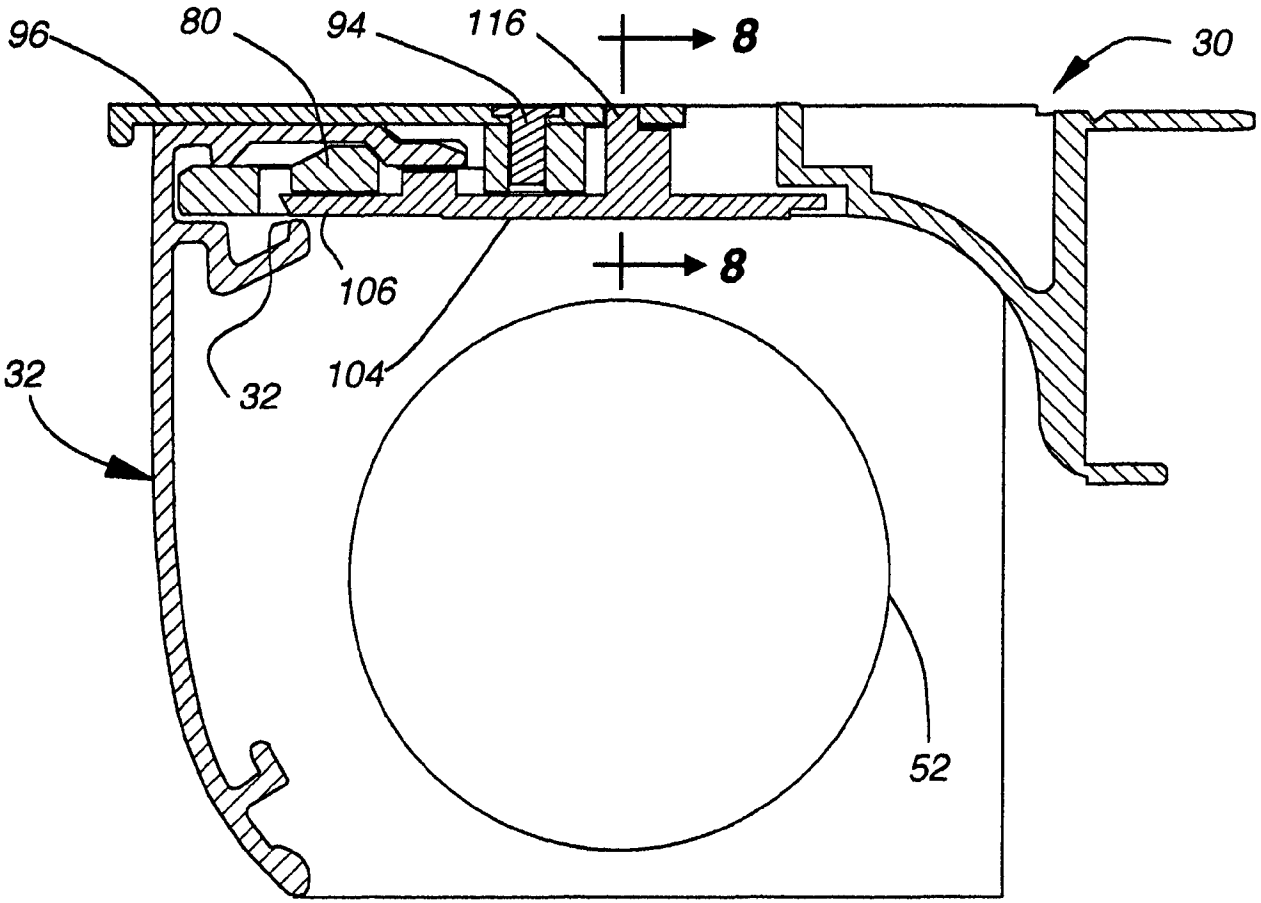
FIG. 7 is a section taken along line 7-7 of FIG. 5.

With the headrail 32 temporarily connected to the mounting bracket 30 as shown in FIG. 9, however, the lock lever 96 can be pivoted into the position of FIG. 3, which as mentioned previously, causes the slide lock bar 104 to move forwardly relative to the base 54 and as seen in FIG. 7, this extreme forward limited movement of the slide-lock bar causes the paddle head 106 to overlie the lip 48 on the support arm 46 of the headrail which prevents the slide-lock bar and the overlying catch arm 76 from being pivoted downwardly. As will be appreciated, if the catch arm cannot pivot downwardly, the headrail is prevented from removal from the mounting bracket due to the engagement of the bevel surfaces 42 and 84.

Obviously, to remove the headrail 32 from the support bracket 30, the lock lever 96 is simply pivoted into alignment with the base 54 as shown in FIG. 4 causing the slide-lock bar 104 to be retracted further into the base so that the paddle head 106 no longer overlies the lip 48 of the support arm 46 whereby upon an outward pull on the headrail, the beveled engagement of the surfaces 42 and 84 will cause the catch arm 76 to pivot downwardly with the slide-lock bar as in FIG. 10 permitting removal of the headrail from the support bracket.

As mentioned previously, the transverse profile of the headrail 32, as illustrated in the drawings, is continuous along the length of the headrail so that any number of support brackets 30 can be positioned for receipt of the headrail. Each support bracket would be operated similarly to remove the headrail from the support bracket or to permit its mounting. It should also be appreciated the gripping rib 126 on the lock lever protrudes forwardly from the front wall 34 of the headrail 32 a sufficient distance to allow an operator to grip the lock lever and move it between locking and release positions. Further, the lock lever can be made of a clear plastic material so as to be less visible for aesthetic purposes.

Although the present invention has been described with a certain degree of particularity, it is understood the present disclosure has been made by way of example and changes in detail or structure may be made without departing from the spirit of the invention as defined in the appended claims.

The invention claimed is:

1. A system for mounting a headrail for a covering for an architectural opening on a mounting bracket comprising in combination:

the headrail having a support arm and a wall spaced therefrom to define a pocket therebetween, and the mounting bracket including:

(a) means for connecting the mounting bracket to a frame of an architectural opening;

(b) a base adapted to be inserted into said pocket;

(c) a depressible catch arm on said base movable from a neutral position operatively engageable with said wall to releasably secure said base in said pocket;

(d) a lock bar mounted on said base in operative relationship with said catch arm, said lock bar being slidably movable between locking and release positions, said lock bar engaging said support arm in said locking position to prevent depression of said catch arm to positively secure said headrail to said mounting bracket; and (e) a lock lever operatively associated with said lock bar for moving said lock bar between said locking and release positions, wherein the lock lever has an arcuate push-pull slot, said arcuate push-pull slot slidably receiving a portion of the lock bar so that as the lock lever is pivoted between locking and release positions the lock bar is actuated so that it slides between corresponding locking and release positions.

2. The system of claim 1 wherein said wall of said headrail has a bevel surface and said catch arm has a bevel surface engageable with said bevel surface of said wall when in said neutral position, and wherein said engagement is releasable except when said lock bar is in the locking position.

3. The system of claim 2 wherein said catch arm has a second bevel surface engageable with said wall of the headrail when said headrail is being mounted on said headrail so as to depress said catch arm from said neutral position.

4. The system of claim 1 wherein said headrail has a front wall and said lock lever protrudes beyond said front wall when the headrail is positioned on said mounting bracket and said lock bar is in said locking position.

5. The system of claim 1 wherein said lock lever is pivotally connected to said base and includes said push-pull slot, and said lock bar has a pin slidably received in said slot to affect linear sliding movement of said lock bar upon pivotal movement of said lock lever.

6. The system of claim 1 wherein there are a plurality of said mounting brackets.

* * * * *